US008022108B2

(12) United States Patent
Bull et al.

(10) Patent No.: US 8,022,108 B2
(45) Date of Patent: Sep. 20, 2011

(54) ACID TREATMENT OF A FISCHER-TROPSCH DERIVED HYDROCARBON STREAM

(75) Inventors: Lucy M. Bull, Pinole, CA (US); Donald L. Kuehne, Hercules, CA (US); William L. Schinski, San Rafael, CA (US); Philippus Rudolf Heydenrich, Centurion (ZA); Richard O. Moore, Jr., San Rafael, CA (US); Quintin John Beukes, St. Francis Bay (ZA); Gianni Guilio Eligio Bacco Rodriquez, Sasolburg (ZA)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/613,422

(22) Filed: Jul. 2, 2003

(65) Prior Publication Data

US 2005/0004239 A1 Jan. 6, 2005

(51) Int. Cl.
*C07B 63/02* (2006.01)
*C07C 27/26* (2006.01)

(52) U.S. Cl. ..... 518/726; 518/700; 518/710; 518/715; 518/719; 518/720; 518/724; 518/728; 208/252; 208/950

(58) Field of Classification Search ..... 208/252, 208/265, 266, 281, 282, 950; 518/700, 710, 518/715, 719, 720, 724, 726, 728
See application file for complete search history.

(56) References Cited

U.S. PATENT DOCUMENTS

| | | | | |
|---|---|---|---|---|
| 2,540,129 | A | 2/1951 | Lauer et al. | |
| 2,852,546 | A | 9/1958 | Kolling et al. | |
| 2,877,257 | A * | 3/1959 | Cain et al. | 206/252 |
| 3,966,596 | A | 6/1976 | Stevens et al. | |
| 4,101,460 | A | 7/1978 | Small et al. | |
| 4,347,121 | A | 8/1982 | Mayer et al. | |
| 4,477,597 | A | 10/1984 | Lee et al. | |
| 4,568,663 | A | 2/1986 | Mauldin | |
| 4,724,082 | A | 2/1988 | Boom | |
| 4,810,357 | A | 3/1989 | Chester et al. | |
| 4,874,733 | A | 10/1989 | Miller et al. | |
| 4,976,848 | A | 12/1990 | Johnson | |
| 4,983,560 | A | 1/1991 | Copperthwaite et al. | |
| 5,019,543 | A | 5/1991 | Davis | |
| 5,378,348 | A * | 1/1995 | Davis et al. | 208/27 |
| 5,486,542 | A | 1/1996 | Posthuma et al. | |
| 6,179,995 | B1 | 1/2001 | Cash et al. | |
| 6,359,018 | B1 | 3/2002 | O'Rear et al. | |
| 6,476,086 | B1 * | 11/2002 | Zhou | 518/719 |
| 2002/0013375 | A1 * | 1/2002 | Roy-Auberger et al. | 518/715 |
| 2002/0173556 | A1 * | 11/2002 | Moore et al. | 518/726 |

FOREIGN PATENT DOCUMENTS

EP 0579330 B1 1/1994

(Continued)

OTHER PUBLICATIONS

U.S. Appl. No. 10/613,423 Moore, et al., *Distillation of a Fischer-Tropsch Derived Hydrocarbon Stream* filed Jul. 2, 2003.

(Continued)

*Primary Examiner* — Prem C Singh
(74) *Attorney, Agent, or Firm* — Merchant & Gould PC

(57) ABSTRACT

Novel methods of treating a Fischer-Tropsch product stream with an acid are disclosed. Such methods are capable of removing contamination from the Fischer-Tropsch product stream such that plugging of the catalyst beds of a subsequent hydroprocessing step is substantially reduced.

29 Claims, 4 Drawing Sheets

FOREIGN PATENT DOCUMENTS

| | | | |
|---|---|---|---|
| EP | 0921184 | A1 | 6/1999 |
| EP | 1108775 | | 6/2001 |
| WO | WO 00/11113 | | 3/2000 |
| WO | WO 02/07883 | A2 | 1/2002 |
| WO | WO03/013725 | A1 | 2/2003 |

OTHER PUBLICATIONS

U.S. Appl. No. 10/613,058 Mayer, et al., *Catalytic Filtering of a Fischer-Tropsch Derived Hydrocarbon Stream* filed Jul. 2, 2003.

U.S. Appl. No. 10/613,421 Bull, et al., *Ion Exchange Methods of Treating a Fischer-Tropsch Derived Hydrocarbon Stream* filed Jul. 2, 2003.

Bala, P., et al., "Dehydration Transformation in Ca-Montmorillonite", *Bull. Mater. Sci*. 23(1): 61-67 (2000).

International Search Report dated Nov. 16, 2004.

Netherlands Search Report dated Aug. 11, 2005.

* cited by examiner

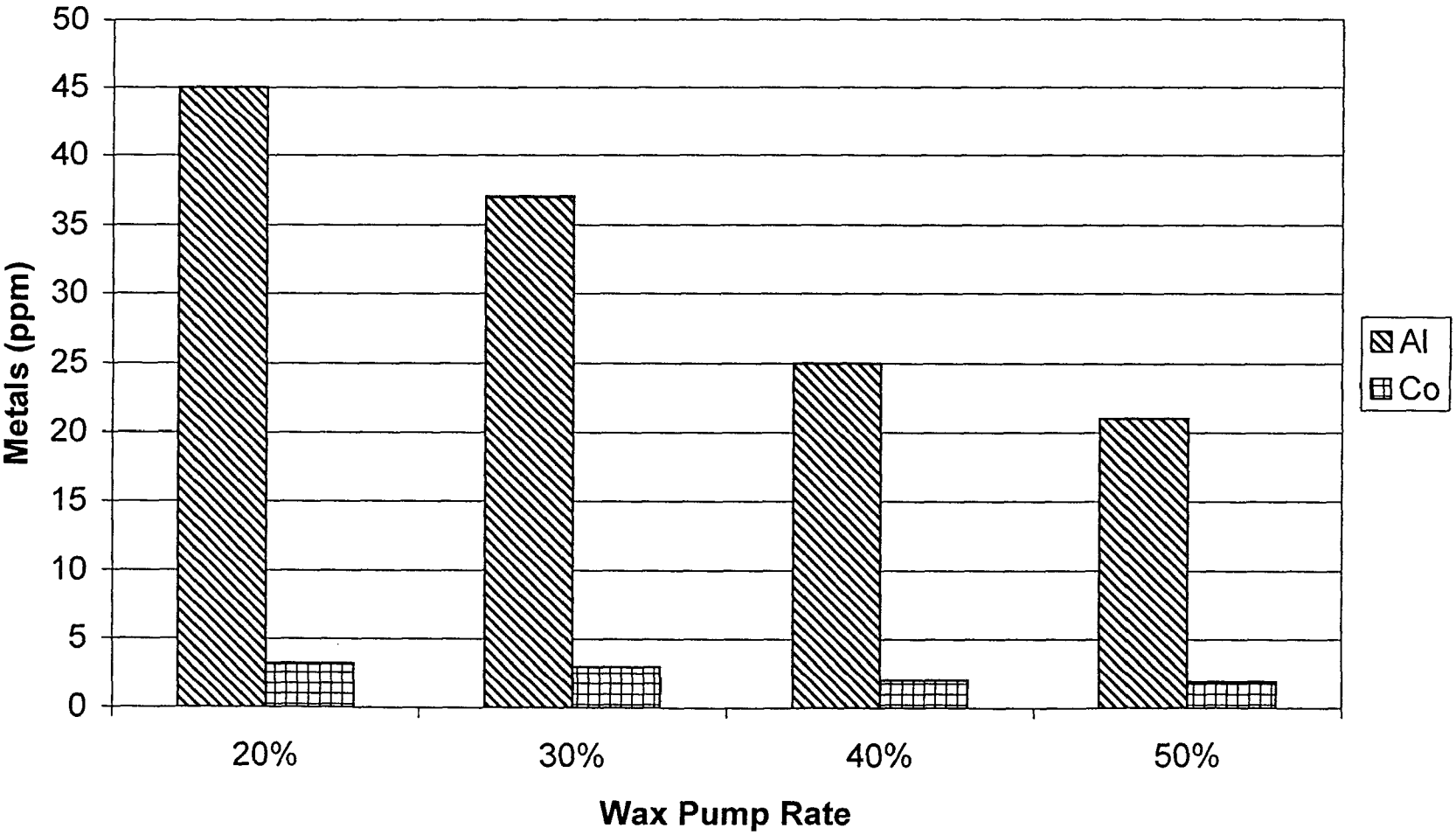
Fig. 4: Static FT Water, Wax Flow

ACID TREATMENT OF A FISCHER-TROPSCH DERIVED HYDROCARBON STREAM

REFERENCE TO RELATED APPLICATIONS

The present application hereby incorporates by reference in its entirety U.S. patent application Ser. No. 10/613,423, entitled "Distillation of a Fischer-Tropsch Derived Hydrocarbon Stream," by Richard O. Moore, Jr., Donald L. Kuehne, and Richard E. Hoffer; filed Jul. 2, 2003; now abandoned U.S. patent application Ser. No. 10/613,058, entitled "Catalytic Filtering of a Fischer-Tropsch Derived Hydrocarbon Stream," by Jerome F. Mayer, Andrew Rainis, and Richard O. Moore, Jr.; now U.S. Pat. No. 7,150,823 and U.S. patent application Ser. No. 10/613,421, entitled "Ion Exchange Methods of Treating a Fischer-Tropsch Derived Hydrocarbon Stream," by Lucy M. Bull and Donald L. Kuehne; filed Jul. 2, 2003; now abandoned.

BACKGROUND OF THE INVENTION

1. Field of the Invention

The present invention relates in general to the hydroprocessing of products from a Fischer-Tropsch synthesis reaction. More specifically, embodiments of the present invention are directed toward an acid extraction process for effectively removing contaminants, fouling agents, and/or plugging precursors from the Fischer-Tropsch hydrocarbon stream prior to sending that product stream to a hydroprocessing reactor.

2. State of the Art

The majority of the fuel used today is derived from crude oil, and crude oil is in limited supply. However, there is an alternative feedstock from which hydrocarbon fuels, lubricating oils, chemicals, and chemical feedstocks may be produced; this feedstock is natural gas. One method of utilizing natural gas to produce fuels and the like involves first converting the natural gas into an "intermediate" known as syngas (also known as synthesis gas), a mixture of carbon monoxide (CO) and hydrogen ($H_2$), and then converting that syngas into the desired liquid fuels using a process known as a Fischer-Tropsch (FT) synthesis. A Fischer-Tropsch synthesis is an example of a so-called gas-to-liquids (GTL) process since natural gas is converted into a liquid fuel. Typically, Fischer-Tropsch syntheses are carried out in slurry bed or fluid bed reactors, and the hydrocarbon products have a broad spectrum of molecular weights ranging from methane ($C_1$) to wax ($C_{20+}$).

The Fischer-Tropsch products in general, and the wax in particular, may then be converted to products including chemical intermediates and chemical feedstocks, naphtha, jet fuel, diesel fuel, and lubricant oil basestocks. For example, the hydroprocessing of Fischer-Tropsch products may be carried out in a trickle flow, fixed catalyst bed reactor wherein hydrogen ($H_2$), or a hydrogen enriched gas, and the Fischer-Tropsch derived hydrocarbon stream comprise the feed to the hydroprocessing reactor. The hydroprocessing step is then accomplished by passing the Fischer-Tropsch derived hydrocarbon stream through one or more catalyst beds within the hydroprocessing reactor with a stream of the hydrogen enriched gas.

In some cases, the feeds to be hydroprocessed contain contaminants that originate from upstream processing. These contaminants may take either a soluble or particulate form, and include catalyst fines, catalyst support material and the like, and rust and scale from upstream processing equipment. Fischer-Tropsch wax and heavy products, especially from slurry and fluid bed processes, may contain particulate contaminants (such as catalyst fines) that are not adequately removed by filters provided for that purpose. The removal of those particulates prior to hydroprocessing may be complicated by the potentially high viscosities and temperatures of the wax stream leaving the Fischer-Tropsch reactor.

The typical catalyst used in a hydroprocessing reactor demonstrates a finite cycle time; that is to say, a limited time (or amount) of usefulness before it has to be replaced with a new catalyst charge. The duration of this cycle time usually ranges from about six months to four years or more. It will be apparent to one skilled in the art that the longer the cycle time of a hydroprocessing catalyst, the better the operating efficiency of the plant.

Soluble and/or particulate contaminants can create serious problems if they are introduced into the hydroprocessing reactor with the feed. The soluble contaminants pose a problem when, under certain conditions of hydroprocessing, they precipitate out of solution to become particulates. The contamination can cause partial or even complete plugging of the flow-paths through the catalyst beds as the contamination accumulates on the surfaces and interstices of the catalyst. In effect, the catalyst pellets filter out particulate contamination from the feed. In addition to trapping debris that is entrained in the feed, the catalyst beds may also trap reaction by-products from the hydroprocessing reaction itself, an example of such a reaction by-product being coke. Plugging can lead to an impairment of the flow of material through the catalyst bed(s), and a subsequent buildup in the hydraulic pressure-drop across the reactor (meaning the pressure differential between the ends of the reactor where the entry and exit ports are located, respectively). Such an increase in pressure-drop may threaten the mechanical integrity of the hydroprocessing reactor internals.

There are at least two potentially undesirable consequences of catalyst bed plugging. One is a decrease in reactor throughput. A more serious consequence is that a complete shut down of the reactor may be required to replace all or part of the catalyst charge. Either of these consequences can have a negative effect on operating plant economics.

Prior art attempts to manage the problem of catalyst bed plugging in hydroprocessing reactors have been directed toward eliminating at least a portion of the particulate contamination in the feed by filtering the feed prior to its introduction to the hydroprocessing reactor. Such conventional filtration methods are usually capable of removing particulates larger than about 1 micron in diameter. Other prior art methods have been directed toward either controlling the rate of coking on the hydroprocessing catalyst, selecting a feed that is not likely to produce coke, or judiciously choosing the hydroprocessing conditions (conditions such as hydrogen partial pressure, reactor temperature, and catalyst type) that affect coke formation.

The present inventors have found, however, that the above-mentioned open art methods are not effective at removing very small sized particle (or soluble) contaminants, fouling agents, and/or plugging-precursors (hereinafter referred to as "contamination") from the feedstream to a hydroprocessing reactor when that feedstream comprises a Fischer-Tropsch derived hydrocarbon stream. This is particularly true when the Fischer-Tropsch derived hydrocarbon stream is a wax produced by a slurry bed or fluid bed process. Typical open art methods have therefore not been found to be effective at avoiding the pressure-drop buildup in a hydroprocessing, hydroisomerization, or hydrotreating reactor when that buildup is caused either by particulate contamination, or by soluble contamination that precipitates out of solution.

The apparent failure of typical open art methods has been attributed to either the presence in the hydroprocessing reactor feed of finely divided, solid particulates with diameters of less than about 1 micron, and/or to a soluble contaminant, possibly having a metallic component, with the ability to precipitate out of solution adjacent to or within the hydroprocessing reactor catalyst beds. What is needed is a method of removing particulates, contaminants, soluble contamination, fouling agents, and plugging precursors from the feedstream to a hydroprocessing reactor such that pressure drop buildup within the hydroprocessing reactor is substantially avoided.

SUMMARY OF THE INVENTION

A Fischer-Tropsch synthesis is an example of a so-called gas-to-liquids (GTL) process, where natural gas is first converted into syngas (a mixture substantially comprising carbon monoxide and hydrogen), and the syngas then converted into the desired liquid fuels. Typically, Fischer-Tropsch syntheses are carried out in slurry bed or fluid bed reactors, and the hydrocarbon products have a broad spectrum of molecular weights ranging from methane ($C_1$) to wax ($C_{20+}$). The Fischer-Tropsch products in general, and the wax in particular, may then be hydroprocessed to form products in the distillate fuel and lubricating oil range. According to embodiments of the present invention, hydroprocessing may be conducted in either an upflow or downflow mode. The present process is particularly applicable to operation in the downflow mode.

In some cases, the feeds to be hydroprocessed contain contamination that originates from upstream processing. This contamination may include catalyst fines, catalyst support material and the like, and rust and scale from upstream processing equipment. Fischer-Tropsch wax and heavy products, especially from slurry and fluid bed processes, may contain contamination (such as catalyst fines) that is not adequately removed by filters provided for that purpose. Contamination can create a serious problem if it is introduced into the hydroprocessing reactor with the feed. The contamination can cause partial or even complete plugging of the flow-paths through the catalyst beds as the contamination accumulates on the surfaces and interstices of the catalyst.

The present inventors have found new methods that are effective at removing contamination, which may include particulates, solidified contaminants, soluble contamination, fouling agents, and/or plugging-precursors from the feed stream to a hydroprocessing reactor when that feed comprises a Fischer-Tropsch derived hydrocarbon stream. The consequences of contamination in the Fischer-Tropsch derived hydrocarbon stream typically include a pressure-drop buildup in the hydroprocessing reactor.

In one embodiment of the present invention, contamination is removed from a Fischer-Tropsch derived hydrocarbon stream using the steps:

a) passing a Fischer-Tropsch derived hydrocarbon stream to an treatment zone;

b) passing an aqueous acidic stream to the treatment zone;

c) contacting the Fischer-Tropsch derived hydrocarbon stream with the aqueous acidic stream in the treatment zone to form a mixed stream; and d) separating the mixed stream into at least one treated Fischer-Tropsch derived hydrocarbon stream, and at least one modified aqueous acidic stream.

The contacting step may form a third phase that is substantially distinct from the at least one extracted Fischer-Tropsch derived hydrocarbon stream and the at least one modified aqueous acidic stream. The aqueous acidic stream extracts contamination from the Fischer-Tropsch derived hydrocarbon stream and isolates it in the third phase. The contamination comprises an inorganic component that may include Al, Co, Ti, Fe, Mo, Na, Zn, Si, and Sn. Furthermore, the contamination originates from upstream processing equipment, or from the catalyst used to produce the Fischer-Tropsch derived hydrocarbon stream. The size of the contamination is such that the contamination may be passed through a 1.0 micron filter.

According to embodiments of the present invention, the contacting step may be performed as either a batch or continuous process. Furthermore, the aqueous acid stream comprises an acid dissolved in water, and wherein the concentration of the acid in the water ranges from about 0.0001 to 1 M. In another embodiment, the concentration of the acid in the water ranges from about 0.01 to 0.1 M. The acidic component may comprise an organic acid selected from the group consisting of formic acid, acetic acid, propionic acid, butyric acid, and oxalic acid, or it may comprise an inorganic acid selected from the group consisting of hydrochloric acid, sulfuric acid, and nitric acid.

The treating step may be performed in a mixing apparatus, wherein the mixing apparatus is selected from the group consisting of a mixing valve, an orifice plate, an inline static mixer, an extraction column with sparger, and a commercial mixing apparatus. The extraction column may be configured as a wax bubble column, a two-phase injection, and an acid spray column.

The present embodiments may further include the step of filtering the Fischer-Tropsch derived hydrocarbon stream, and the filtering step is performed after the contacting step. There may be further included in the present methods the step of distilling the Fischer-Tropsch derived hydrocarbon stream, or the step of adding a surfactant to the Fischer-Tropsch derived hydrocarbon stream. The extracted Fischer-Tropsch derived hydrocarbon stream may be passed to a hydroprocessing reactor, and embodiments of the present invention substantially avoid plugging of catalyst beds in the hydroprocessing reactor.

In another embodiment of the present invention, the steps comprise:

a) passing the Fischer-Tropsch derived hydrocarbon stream to an treatment zone;

b) passing an aqueous acidic stream to the treatment zone;

c) extracting contamination from the Fischer-Tropsch derived hydrocarbon stream by contacting the Fischer-Tropsch derived hydrocarbon stream with the aqueous acidic stream in the treatment zone at extraction conditions to form a mixed stream; and d) separating at least one extracted Fischer-Tropsch derived hydrocarbon stream from a modified aqueous acidic stream and a third phase;

wherein after the extraction step the contamination contained in the modified aqueous acidic stream and the third phase is greater than the contamination contained in the extracted Fischer-Tropsch derived hydrocarbon stream.

In yet another embodiment of the present invention, the steps comprise:

a) passing a syngas to a Fischer-Tropsch reactor to produce a Fischer-Tropsch derived hydrocarbon stream;

b) providing an additive to the contents of the Fischer-Tropsch reactor to precipitate soluble contamination within the reactor;

c) filtering the precipitated contamination from the Fischer-Tropsch derived hydrocarbon stream to produce a filtered hydrocarbon stream; and d) passing the filtered hydrocarbon stream to a hydroprocessing reactor.

The additive may include an acidic component or a surfactant.

BRIEF DESCRIPTION OF THE DRAWINGS

FIG. 4 is a graph of experimental results showing the benefits of surface area contact between the Fischer-Tropsch reaction products and an acidic solution.

DETAILED DESCRIPTION OF THE INVENTION

Embodiments of the present invention are directed to the hydroprocessing of products from a Fischer-Tropsch synthesis reaction. The present inventors have observed under certain conditions a tendency for the catalyst beds in the hydroprocessing reactor to become plugged by either particulate contamination, or by soluble contaminants that precipitate out of solution in the vicinity of or within the catalyst beds, thus impeding the flow of material through the hydroprocessing reactor. The contamination may still be present (meaning the problem still exists) even when the Fischer-Tropsch derived hydrocarbon stream is filtered to remove particulate debris larger than about 0.1 microns.

Though not wishing to be bound by any particular theory, the inventors believe the contamination may be present (at least partly) in the Fischer-Tropsch derived hydrocarbon stream in a soluble form, and the contamination may then precipitate out of solution to form solid particulates after the stream is charged to, for example, a hydroprocessing reactor. The contamination may or may not originate from a foreign source. Typically, after precipitating, the contamination forms solid plugs in the hydroprocessing reactor. Under certain conditions, the plugging occurs in a central portion of the reactor. The spatial extent of the plugging depends on hydroprocessing conditions and catalyst type, where varying space velocities, for example, can compress or spread the plugging over and/or into different regions of the reactor. Whatever its form, the contamination is an undesirable component(s) in the context of hydroprocessing, since it has the potential to plug the flowpaths through the hydroprocessing reactor.

While it is not certain whether the contamination is present in the Fischer-Tropsch derived hydrocarbon stream as a soluble species, or as an ultra-fine particulate (meaning probably less than about 0.1 microns in size), it is known that the contamination is not generally removed from that hydroprocessing feedstream by conventional filtering.

The inventors have discovered that the contamination (which may also be described as a "fouling agent" or "plugging precursor"), both soluble and particulate forms, may be extracted from the Fischer-Tropsch derived product stream using a dilute aqueous acid solution. When an acid extraction step is performed on the Fischer-Tropsch derived product stream, the pressure-drop buildup in the reactor typically observed with the hydroprocessing of the product stream is substantially avoided.

Figure 1:
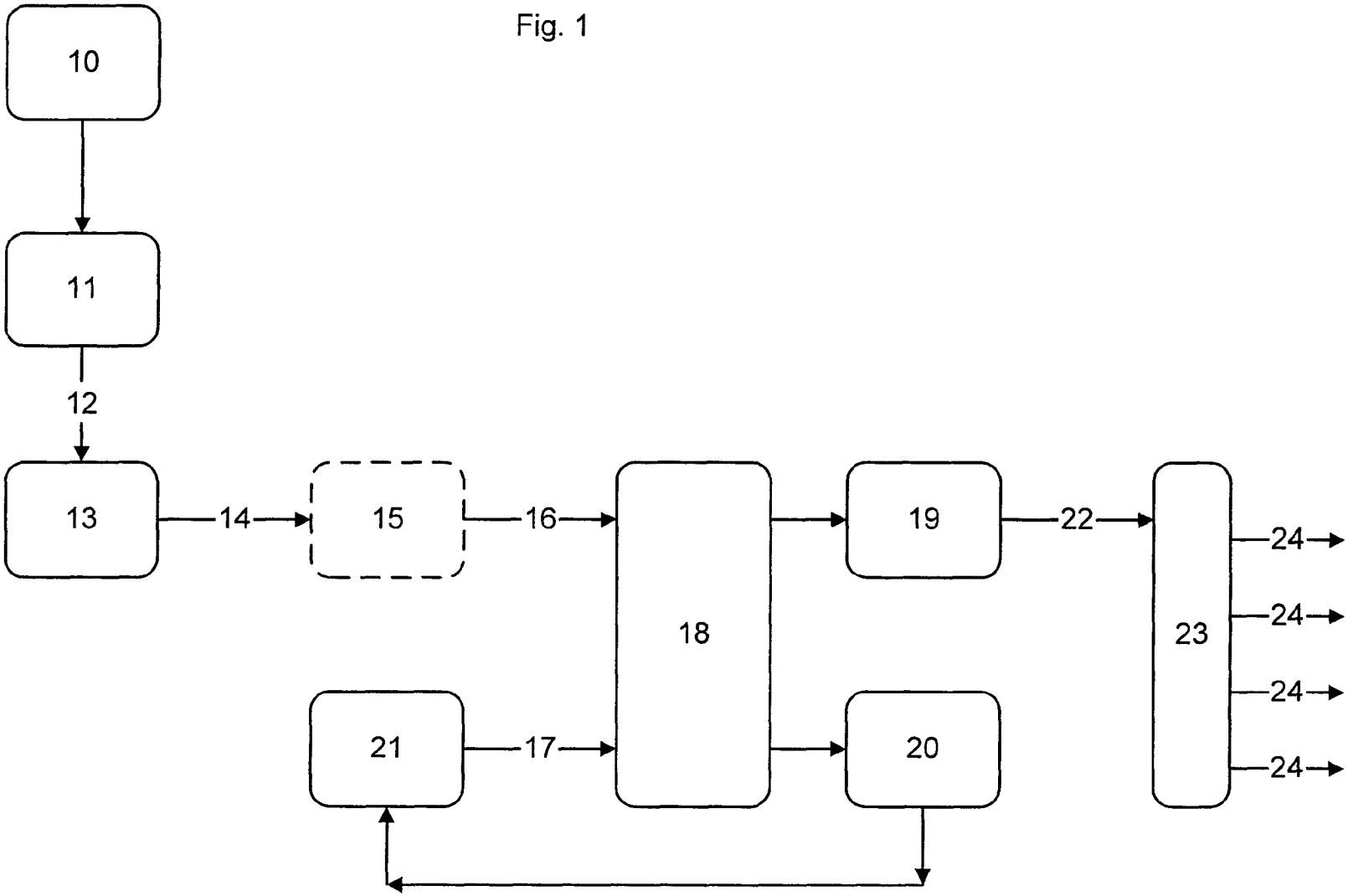
FIG. 1 is an overview of the present process in which the products of a Fischer-Tropsch reaction are filtered, subjected to an acid treatment process, and then sent on to hydroprocessing.

An overview of a process flow that utilizes an acid extraction according to embodiments of the present invention is shown in FIG. 1. Referring to FIG. 1, a carbon source such as a natural gas 10 is converted to a synthesis gas 11, which becomes the feed 12 to a Fischer-Tropsch reactor 13. Typically, the synthesis gas 11 comprises hydrogen and carbon monoxide, but may include minor amounts of carbon dioxide and/or water. A Fischer-Tropsch product stream 14 may optionally be filtered in a step to produce a filtered Fischer-Tropsch product stream 16. The filtered Fischer-Tropsch product stream 16 is combined with a dilute aqueous acid stream 17, and the combined streams are mixed under a desired set of pressure and temperature conditions as part of an acid extraction process in a treatment zone 18. Exiting the acid treatment zone 18 is a treated or extracted Fischer-Tropsch paraffinic phase 19 (which may be a wax) and a modified or spent acidic aqueous phase 20, the latter generally containing the contaminants whose removal from the Fischer-Tropsch product stream 16 was desired.

Under some conditions a third phase may be formed that is substantially distinct from the extracted Fischer-Tropsch derived hydrocarbon stream 19 and the modified aqueous acidic stream 20. The third phase is not shown in FIG. 1. The third phase may be observed, for example, if the extraction is carried out with either a very weak mineral acid (e.g., less than about 0.1 molar), or an organic acid. This third phase can contain high levels of metals, often as high as 10 times the level of metals found in either the treated Fischer-Tropsch product stream 19 or the modified aqueous acid stream 20, depending on the particular acid used and the relative volumes of the acid and the wax. Under these conditions the aqueous acidic stream extracts contamination from the Fischer-Tropsch derived hydrocarbon (wax) stream 16 and concentrates the contamination into the third phase.

Optionally, the modified or spent acidic aqueous phase 20 may be recycled back to the aqueous acid supply 21, or otherwise treated or reconditioned. In any event, the acid extracted Fischer-Tropsch paraffinic phase 19 is sent on as the hydroprocessing feed 22 to a hydroprocessing reactor 23, whereupon hydroprocessing step on the extracted Fischer-Tropsch paraffinic phase is carried out, yielding valuable hydrocarbon products 24. The hydrocarbon products 24 may include middle distillate fuels and lube oil basestocks.

Fischer-Tropsch Synthesis

A Fischer-Tropsch process may be carried out in the Fischer-Tropsch reactor shown schematically at reference numeral 13 in FIG. 1. The Fischer-Tropsch product stream 14 includes a waxy fraction which comprises linear hydrocarbons with a chain length greater than about $C_{20}$. If the Fischer-Tropsch products are to be used in distillate fuel compositions, they are often further processed to include a suitable quantity of isoparaffins for enhancing the burning characteristics of the fuel (often quantified by cetane number), as well as the cold temperature properties of the fuel (e.g., pour point, cloud point, and cold filter plugging point).

In a Fischer-Tropsch process, liquid and gaseous hydrocarbons are formed by contacting the synthesis gas 11 (sometimes called "syngas") comprising a mixture of $H_2$ and CO with a Fischer-Tropsch catalyst under suitable reactive conditions. The Fischer-Tropsch reaction is typically conducted at a temperature ranging from about 300 to 700° F. (149 to 371° C.), where a preferable temperature range is from about 400 to 550° F. (204 to 288° C.); a pressure ranging from about 10 to 600 psia, (0.7 to 41 bars), where a preferable pressure range is from about 30 to 300 psia, (2 to 21 bars); and a catalyst space velocity ranging from about 100 to 10,000 cc/g/hr, where a preferable space velocity ranges from about 300 to 3,000 cc/g/hr.

The Fischer-Tropsch product stream 14 may comprise products having carbon numbers ranging from $C_1$ to $C_{200+}$, with a majority of the products in the $C_5$-$C_{100}$ range. A Fischer-Tropsch reaction can be conducted in a variety of reactor types, including fixed bed reactors containing one or more catalyst beds, slurry reactors, fluidized bed reactors, or a combination of these reactor types. Such reaction processes and reactors are well known and documented in the literature.

In one embodiment of the present invention, the Fischer-Tropsch reactor 13 comprises a slurry type reactor. This type of reactor (and process) exhibit enhanced heat and mass transfer properties, and thus is capable of taking advantage of the strongly exothermic characteristics of a Fischer-Tropsch reaction. A slurry reactor produces relatively high molecular weight, paraffinic hydrocarbons when a cobalt catalyst is employed. Operationally, a syngas comprising a mixture of hydrogen ($H_2$) and carbon monoxide (CO) is bubbled up as a third phase through the slurry in the reactor, and the catalyst (in particulate form) is dispersed and suspended in the liquid. The mole ratio of the hydrogen reactant to the carbon monoxide reactant may range from about 0.5 to 4, but more typically this ratio is within the range of from about 0.7 to 2.75. The slurry liquid comprises not only the reactants for the synthesis, but also the hydrocarbon products of the reaction, and these products are in a liquid state at reaction conditions.

Suitable Fischer-Tropsch catalysts comprise one or more Group VIII catalytic metals such as Fe, Ni, Co, Ru and Re. The catalyst may include a promoter. In some embodiments of the present invention, the Fischer-Tropsch catalyst comprises effective amounts of cobalt and one or more of the elements Re, Ru, Fe, Ti, Ni, Th, Zr, Hf, U, Mg and La on a suitable inorganic support material. In general, the amount of cobalt present in the catalyst is between about 1 and 50 weight percent, based on the total weight of the catalyst composition. Exemplary support materials include refractory metal oxides, such as alumina, silica, magnesia and titania, or mixtures thereof. In one embodiment of the present invention, the support material for a cobalt containing catalyst comprises titania. The catalyst promoter may be a basic oxide such as $ThO_2$, $La_2O_3$, MgO, and $TiO_2$, although promoters may also comprise $ZrO_2$, noble metals such as Pt, Pd, Ru, Rh, Os, and Ir; coinage metals such as Cu, Ag, and Au; and other transition metals such as Fe, Mn, Ni, and Re.

Useful catalysts and their preparation are known and illustrative, and nonlimiting examples may be found, for example, in U.S. Pat. No. 4,568,663.

Any $C_{5+}$ hydrocarbon stream derived from a Fischer-Tropsch process may be suitably treated using the present process. Typical hydrocarbon streams include a $C_5$-700° F. stream and a waxy stream boiling above about 550° F., depending on the Fischer-Tropsch reactor configuration. In one embodiment of the present invention, the Fischer-Tropsch product stream 14 is recovered directly from the reactor 13 without fractionation. If a fractionation step (not shown in FIG. 1) is performed on the products exiting the Fischer-Tropsch reactor 13, the preferred product of the fractionation step for treatment is a bottoms fraction.

Hydroprocessing of the Acid Extracted Fischer-Tropsch Reaction Products

The product stream 14 from the Fischer-Tropsch reactor 13 may be subjected to a hydroprocessing step. This step may be carried out in the hydroprocessing reactor shown schematically at reference numeral 23 in FIG. 1. The term "hydroprocessing" as used herein refers to any of a number of processes in which the products of the Fischer-Tropsch synthesis reaction produced by reactor 13 are treated with a hydrogen-containing gas; such processes include hydrodewaxing, hydrocracking, hydroisomerization, and hydrotreating.

As used herein, the terms "hydroprocessing," "hydrotreating," and "hydroisomerization" are given their conventional meaning, and describe processes that are known to those skilled in the art. Hydrotreating refers to a catalytic process, usually carried out in the presence of free hydrogen, in which the primary purpose is olefin saturation and oxygenate removal from the feed to the hydroprocessing reactor. Oxygenates include alcohols, acids, and esters. Additionally, any sulfur which may have been introduced when the hydrocarbon stream was contacted with a sulfided catalyst is also removed.

In general, hydroprocessing reactions may decrease the chain length of the individual hydrocarbon molecules in the feed being hydroprocessed (called "cracking"), and/or increase the isoparaffin content relative to the initial value in the feed (called "isomerization"). In embodiments of the present invention, the hydroprocessing conditions used in the hydroprocessing step 23 produce a product stream 24 that is rich in $C_5$-$C_{20}$ hydrocarbons, and an isoparaffin content designed to give the desired cold temperature properties (e.g., pour point, cloud point, and cold filter plugging point). Hydroprocessing conditions in zone 23 which tend to form relatively large amounts of $C_{1-4}$ products are generally not preferred. Conditions which form $C_{20+}$ products with a sufficient isoparaffin content to lower the melting point of the wax and/or heavy fraction (such that the particulates larger than 10 microns are more easily removed via conventional filtration) are also preferred.

In some embodiments of the present invention, it may be desirable to keep the amount of cracking of the larger hydrocarbon molecules to a minimum, and in these embodiments a goal of the hydroprocessing step 23 is the conversion of unsaturated hydrocarbons to either fully or partially hydrogenated forms. A further goal of the hydroprocessing step 23 in these embodiments is to increase the isoparaffin content of the stream relative to the starting value of the feed.

The hydroprocessed product stream 24 may optionally be combined with hydrocarbons from other sources such as gas oils, lubricating oil stocks, high pour point polyalphaolefins, foots oil (oil that has been separated from an oil and wax mixture), synthetic waxes such as normal alpha-olefin waxes, slack waxes, de-oiled waxes, and microcrystalline waxes.

Hydroprocessing catalysts are well known in the art. See, for example, U.S. Pat. Nos. 4,347,121, 4,810,357, and 6,359,018 for general descriptions of hydroprocessing, hydroisomerization, hydrocracking, hydrotreating, etc., and typical catalysts used in such processes.

Contamination and Hydroprocessing Catalyst Bed Plugging

As noted above, the Fischer-Tropsch derived hydrocarbon stream 14, 16 may cause plugging of catalyst beds in a hydroprocessing reactor due to contaminants, particulate contamination, soluble contamination, fouling agents, and/or plugging precursors present in the stream 14, 16. The terms particulates, particulate contamination, soluble contamination, fouling agents, and plugging precursors will be used interchangeably in the present disclosure, but the phenomenon will in general be referred to as "contamination," keeping in mind that the entity that eventually plugs the hydroprocessing catalyst bed may be soluble in the feed at some time prior to the plugging event. The plugging event is a result of the contamination (which eventually takes a particulate form), being filtered out of the hydroprocessing feed by the catalyst beds of the hydroprocessing reactor. According to embodiments of the present invention, an acid extraction process in a treatment zone 18 is used to remove contamination, fouling agents, and plugging precursors from the Fischer-Tropsch product stream 14, 16 such that plugging of the catalyst beds of the hydroprocessing reactor 23 is substantially avoided.

It may be beneficial to address contamination in general before discussing the details of the present acid extraction process. Contamination of the Fischer-Tropsch paraffinic product stream 14, 16 can originate from a variety of sources, and, in general, methods are known in the art for dealing with at least some of the forms of the contamination. These methods include, for example, separation, isolation, (conventional) filtration, and centrifugation. Inert impurities such as nitrogen and helium can usually be tolerated, and no special treatment is required.

In general, however, the presence of impurities such as mercaptans and other sulfur-containing compounds, halogen, selenium, phosphorus and arsenic contaminants, carbon dioxide, water, and/or non-hydrocarbon acid gases in the natural gas 10 or syngas 11 is undesirable, and for this reason they are preferably removed from the syngas feed before performing a synthesis reaction in the Fischer-Tropsch reactor 13. One method known in the art includes isolating the methane (and/or ethane and heavier hydrocarbons) component in the natural gas 10 in a de-methanizer, and then desulfurizing the methane before sending it on to a conventional syngas generator to provide the synthesis gas 11. In an alternative prior art method ZnO guard beds may be used for removing sulfur impurities.

Particulate contamination is usually addressed by conventional filtering. Particulates such as catalyst fines that are produced in Fischer-Tropsch slurry or fluidized bed reactors may be filtered out with commercially available filtering systems (in an optional filtering step 15) if the particles are larger than about 10 microns, and in some procedures, one micron. The particulate content of the Fischer-Tropsch product stream 14, 16 (and particularly the waxy fraction thereof) will generally be small, usually less than about 500 ppm on a mass basis, and sometimes less than about 200 ppm on a mass basis. The sizes of the particulates will generally be less than about 500 microns in diameter, and often less than about 250 microns in diameter. In the context of this disclosure, to say that a particle is less than about 500 microns in diameter means that the particle will pass through a screen having a 500 micron mesh size.

The present inventors have found, however, that a significant level of contamination may remain in a Fischer-Tropsch paraffinic product stream even after conventional filtration. Such contamination typically has a high metal content. As previously disclosed, this contamination will usually lead to a plugging problem if left unchecked. A result of the plugging is a decreased hydroprocessing catalyst life.

The contaminants (including metal oxides) that are extracted from the Fischer-Tropsch derived hydrocarbon stream 14, 16, according to embodiments of the present invention, may have both an organic component as well as an inorganic component. The organic component may have an elemental content that includes at least one of the elements carbon, hydrogen, nitrogen, oxygen, and sulfur (C, H, N, O, and S, respectively). The inorganic component may include at least one of the elements aluminum, cobalt, titanium, iron, molybdenum, sodium, zinc, tin, and silicon (Al, Co, Ti, Fe, Mo, Na, Zn, Sn, and Si, respectively).

Acid Treatment of a Fischer-Tropsch Product Stream

Acid extraction techniques are also known in the art, but to the inventors' knowledge, these techniques have only been used to manufacture or produce a Fischer-Tropsch catalyst. Acid extraction has also been used to improve the activity of a Fischer-Tropsch catalyst, and to enhance the selectivity of a Fischer-Tropsch catalyst, so that the desired Fischer-Tropsch paraffinic products may be produced. See, for example, U.S. Pat. No. 4,874,733.

To the inventors' knowledge, acid extraction has not been used heretofore to purify and/or de-contaminate a Fischer-Tropsch waxy product stream, due in part to the fact that the contamination levels of such streams are not nearly as high as those of a typical crude oil feedstock. In fact, Fischer-Tropsch paraffinic product streams contain mostly particulate contaminates, much of which may readily be removed by conventional filtration techniques.

The inventors have discovered that acid extraction of an optionally filtered Fischer-Tropsch paraffinic product stream, the hydrocarbon stream having been produced by a slurry bed or fluid bed Fischer-Tropsch process, can substantially remove contaminants, particulate contamination, soluble contamination, fouling agents, and/or plugging precursors from the hydrocarbon stream such that plugging of a downstream hydroprocessing reactor is substantially avoided. The acid extraction may be carried out in any commercially available mixing apparatus, such as a mixing valve or an inline static mixer. According to embodiments of the present invention, the extraction conditions allow sufficient and intimate contact between the acid and the Fischer-Tropsch derived hydrocarbon stream to substantially remove the contamination from the hydrocarbon stream, and to allow separation of the contents of the mixing apparatus into an extracted Fischer-Tropsch paraffinic product stream and a spent (which may also be described as a modified) aqueous acid stream.

Methods for carrying out the above mentioned embodiments include using 1) an inline mixer and settler, 2) a counter-current extraction column, where wax that has been introduced through a sparger then rises through a column of acid that comprises a continuous phase within the column, and where the acid moves in a downflow direction (hence the term "counter-current"), 3) a counter-current extraction column where the wax is the continuous phase and the acid is introduced through a sparger, and 4) a fourth configuration that comprises two stages of separation within a single column.

In the above-mentioned fourth configuration, an upper portion of the column is operated as an acid spray column with the wax as the continuous phase, and a lower portion of the column is operated as a wax bubble column with acid as the continuous phase. With a configuration such as this, there may be a "gray layer" (a third phase) that accumulates between the upper continuous wax phase and the lower continuous acid phase, and if such an interfacial gray layer exists, it may be drawn off periodically. Both the wax phase and acid phase move in directions counter-current to one another as they travel through the single column of this configuration. In a modified embodiment, the column may be positioned within a large settling tank. Advantages of this configuration are that a more efficient removal of contamination may be effected, since there are two stages in the column instead of one, and that there are fewer columns, tanks, and other equipment required to carry out the acid treatment process.

In methods that involve a counter-current extraction column, it may be desirable to maintain a small droplet size such that the formation of an emulsion is substantially avoided.

While not wishing to be limited by theory, it is believed that the contamination to which the present embodiments are directed could comprise a very finely divided inorganic contaminate, or a contaminate containing at least one inorganic component. In the latter case the inorganic component may comprise a metal such as aluminum, and the metal may be present in a complex organic matrix consisting of at least one or more organic components comprising carbon, nitrogen, sulfur, or oxygen. The complex organic matrix may exist in a particulate or soluble state.

The details of the extraction process in a treatment zone 18 will now be given with reference to FIG. 1. According to embodiments of the present invention, the Fischer-Tropsch paraffinic product stream 14 leaving the Fischer-Tropsch slurry reactor or fluid bed reactor 13 may contain particulates in the form of catalyst fines formed during the reactions that takes place during the Fischer-Tropsch synthesis in reactor 13. These particulates are generally less than about 500 microns in diameter, with some of the particulates having a diameter less than about 0.1 microns.

Removing the slurry from the Fischer-Tropsch reactor 13 generally involves a conventional filtering step to separate the catalyst from the slurry. Particulate materials having a diameter greater than about 10 microns, and in some embodiments diameters greater than about one micron, are removed in this conventional filtering step. The Fischer-Tropsch product stream 14 may further be further subjected to an optional filtration step 15. Particulates may be removed from the Fischer-Tropsch product stream 14 using one or more of a variety of methods for removing particulate matter known in the art. In one embodiment of the present invention, the Fischer-Tropsch paraffinic product stream 14 is cooled at least 100° F. below the temperature at which the stream is to be hydroprocessed in hydroprocessing step 23, and after cooling the product stream 14 is then passed through a package filter system to remove at least some of the particulate contamination. The package filter system may comprise a disposable cartridge filter to facilitate the removal of the particulates. The temperature at which the filtering step 15 is performed depends on the nature and choice of the filtering system.

The filtered Fischer-Tropsch paraffinic product stream 16 is then passed to the treatment zone 18 at a feed rate dependent on the size and configuration of the treatment zone. The selected feed rate will allow sufficient mixing and residence time in the treatment zone to achieve the desired conversion or removal of contaminants in the paraffinic product stream. The treatment zone 18 is maintained at a temperature ranging from about the melting point of the wax feed (about 200° F.) upwards to about 600° F., the upper temperature limit being the temperature at which the wax typically begins to thermally crack. The pressure in the treatment zone may range from about ambient pressure to 250 pounds per square inch (psi), although the results of the extraction process are not notably pressure dependent. However, sufficient pressure is needed to keep the aqueous acid stream from boiling.

A dilute aqueous acid stream 17 from an aqueous acid supply 21 is also passed to the treatment zone 18, the dilute aqueous acid stream 17 having a concentration ranging in one embodiment from about 0.0001 M to 1.0 M, and in another embodiment from about 0.01 M to 0.1 M. The lower limit of the acid concentration is generally driven by the concentration of the contamination (often aluminum) whereupon a 1:1 stoichiometric ratio of the acid to the contamination may be desirable. In practice, the lower limit of the acid concentration may be quantified by acid strength. For example, the lower limit of the acid concentration may be about 0.0001 M. In terms of pH, the lower limit of the acid concentration may be expressed in a pH range of about 3.7 to 4.0.

The upper limit that may be chosen for the acid concentration depends on the resistance of the extraction apparatus to corrosion, along with the combination of temperature and acidity that causes the wax to crack.

The acid used in the dilute aqueous acid stream 17 may comprise an inorganic (mineral) acid or an organic acid. Typical inorganic acids include, but are not limited to, hydrochloric acid (HCl), sulfuric acid ($H_2SO_4$), and nitric acid ($HNO_3$). Typical organic acids include, but are not limited to, formic acid, acetic acid, propionic acid, butyric acid, and oxalic acid. According to one embodiment of the present invention a preferred inorganic acid is $H_2SO_4$, and in another embodiment, a preferred organic acid is oxalic acid. For these acids the concentration of the acid in the dilute aqueous acid stream 17 may range from about 0.0001 M to 1.0 M.

In a separate embodiment, the aqueous acid stream is recovered from the Fischer-Tropsch process. The Fischer-Tropsch hydrocarbon synthesis generates substantial amounts of water, termed "reaction water," as one step of the carbon oxides reaction process. The reaction water generally comprises acids, alcohols, and other reaction products from the Fischer-Tropsch reaction in addition to water. Reaction water is often quite acidic, with a pH of less than about 4 and often less than about 3. As such, it is also useful according to present embodiments to use reaction water as the acid source for removing contaminants from the Fischer-Tropsch derived hydrocarbon stream. The predominant acidic species in reaction water may be acetic acid.

The Fischer-Tropsch product stream 16 and the dilute aqueous acid stream 17 are then combined either prior to or during a mixing portion of the acid extraction in zone 18 as part of either a batch or continuous process. Although the two streams 16, 17 are shown entering the acid extraction apparatus separately in FIG. 1, it will be understood by those of ordinary skill in the art that the two streams 16, 17 may be combined prior to being charged to the mixing apparatus in which the acid extraction process in treatment zone 18 is performed. In one embodiment of the present invention, the two streams 16, 17 are mixed at a 2:1 ratio by weight; in other words, the combined stream may comprise about twice as much by weight of the Fischer-Tropsch paraffinic/wax stream 16 to the dilute aqueous acid stream 17. In other embodiments, the upper and lower limits on the ratio of the volumes of the two streams 16, 17 may be estimated based on the contamination level and on the acid concentration.

The duration of the mixing in the acid extraction process in treatment zone 18 is sufficient to achieve removal of a substantial amount of the contaminants from the Fischer-Tropsch paraffinic product stream 16. The contact time of the stream 16 with the stream 17 during the acid extraction process 18 may range from less than about one minute if intense mixing is employed, to several hours or more including as long as several days, if the mixing is gentle. The acid extraction process in treatment zone 18 may be performed in a commercial mixing apparatus such as a mixing valve or an inline static mixer, or a counter-current extraction column. The effluent from the acid extraction process in treatment zone 18 is then allowed to separate into an extracted Fischer-Tropsch paraffinic product phase 19 (which may also be called an extracted Fischer-Tropsch paraffinic phase 19), and an at least partially spent or modified aqueous acid phase 20 that contains a substantial portion of the contaminants originally contained in the stream 16. As noted earlier, a third phase may be present in which the majority of the contamination has been concentrated, but whether the contamination is present in the third phase or the spent aqueous acid phase 20 is moot, since the desired removal of substantial levels of contamination from the product stream 16 has been achieved. The extracted Fischer-Tropsch paraffinic product stream 22 is then passed to a hydroprocessing reactor 23 to produce the desired finished products 24.

Optionally, the at least partially spent aqueous acid stream 20 may be recycled to the aqueous acid supply 21 for regeneration, or it may be discarded, or used in one of a number of applications. In some embodiments, the spent aqueous acid stream 20 may be recycled many times before regeneration is necessary depending on the concentration of the fresh acid and the level of contamination that existed in the product stream 16.

Figure 2:
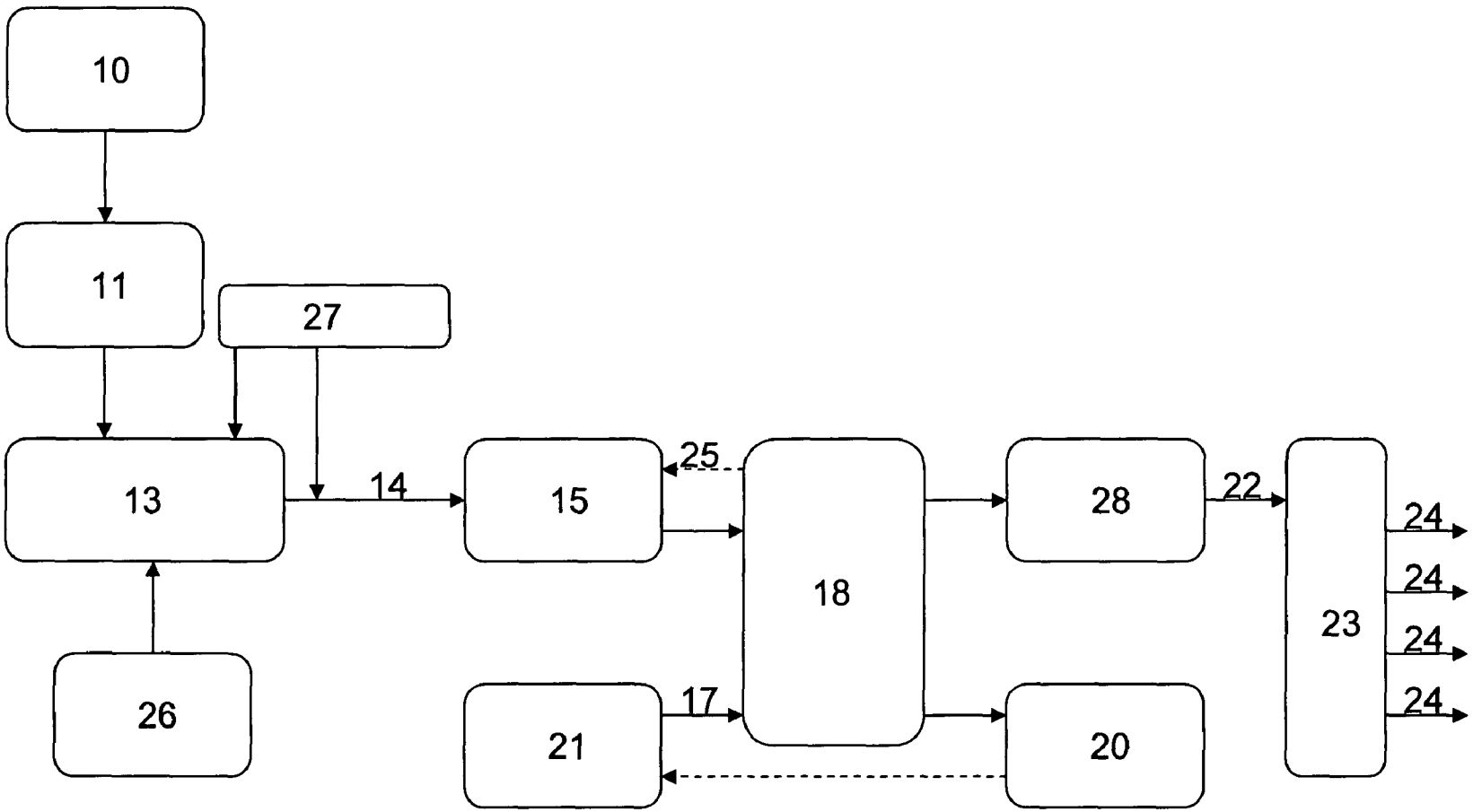
FIG. 2 is an overview of an alternate embodiment of the present invention, where an acid treatment step may be performed prior to a filtering step.

While not wishing to be limited by any particular theory, the acid extraction process 18 appears to convert soluble metal contaminants into a particulate form and may agglomerate very small particulate contaminants into larger particulates, which may then be removed by filtering. This embodiment is illustrated in FIG. 2. Referring to FIG. 2, a natural gas 10 may be converted to a syngas 11, which is passed to a Fischer-Tropsch reactor 13, as before. In this embodiment, however, the effluent products 14 from the Fischer-Tropsch reactor 13 are first passed to an acid treatment 18 before a secondary filtering step (in this case filtering step 28) is carried out.

The filtering step 15 may be termed a "primary" filtering step because this is the stage of the filtering that removes the majority of the Fischer-Tropsch catalyst fines from the Fischer Tropsch product stream 14. These particulates may be about 10 microns or larger in size in some situations, and 1 micron or larger in other situations. It should be noted that the filtering step 15 may be performed either inside or outside of the reactor 13.

Referring again to FIG. 2, a secondary filtering step 28 may be performed after the acid treatment 18 to remove the soluble metal contaminants that had been converted into a particulate form by the acid treatment 18. Selection of the type of filtering element in step 28 is all that is required to reduce the metal contamination problem once the acid treatment step 18 has been accomplished.

In a variation of this embodiment, at least a portion of the effluent 25 from the acid treatment process 18 may be recycled to the primary filter 15 such that the primary filter 15 may remove precipitated contamination whose precipitation was instigated by the acid treatment 18. Such a configuration may obviate the need for a secondary filter 28.

In accordance with the embodiments of FIG. 2, the present inventors have used a 0.45 micron filter to remove aluminum contamination from a Fischer-Tropsch product stream rendered insoluble or filterable by an acid treatment 18. The contamination was reduced to a level below the detectable limits as measured by ICP-AES (inductively coupled plasma atomic emission spectroscopy).

In an alternate embodiment (also depicted in FIG. 2), an additive 26 to the Fischer-Tropsch reactor 13 causes the precipitation and/or agglomeration of soluble contamination within the reactor 13. The additive 26 may be acidic in nature, and the contamination within the reactor whose precipitation is desired may have a metallic component. The precipitated contamination is then filtered out of the product stream by either the primary filter 15 or the secondary filter 28. Advantages of precipitating the soluble contamination using an additive 26 are that no additional significant equipment is required, since the apparatus for carrying out a filtration process is already present in the system.

In an alternative embodiment (also illustrated in FIG. 2), a surfactant 27 may be added to the Fischer-Tropsch product stream 14. The present inventors have found that the addition of such a surfactant 27 enhances the removal of contamination from the product stream 14, particularly soluble contamination having a metallic component. An example of a surfactant useful in this embodiment is $C_{16}H_{32}N(CH_3)_3Br$. The inventors note that the Fischer-Tropsch product stream 14 may contain compounds that have in themselves surfactant-like properties that may also enhance the agglomeration of contamination within the Fischer-Tropsch reactor 13.

As if FIG. 1, the extracted Fischer-Tropsch paraffinic product stream 22 is passed to a hydroprocessing reactor 23 to produce the desired finished products 24. Likewise, a dilute aqueous acid stream 17 from an aqueous acid supply 21 is also passed to the treatment zone 18, and an at least partially spent or modified aqueous acid phase 20 that contains a substantial portion of the contaminants is recovered.

Fischer-Tropsch Synthesis Reaction Water as an Acid Source

In one embodiment of the present invention, reaction water from the Fischer-Tropsch synthesis reaction may be used as the source of the aqueous acid supply 21. This embodiment is illustrated in FIG. 3.

Figure 3:
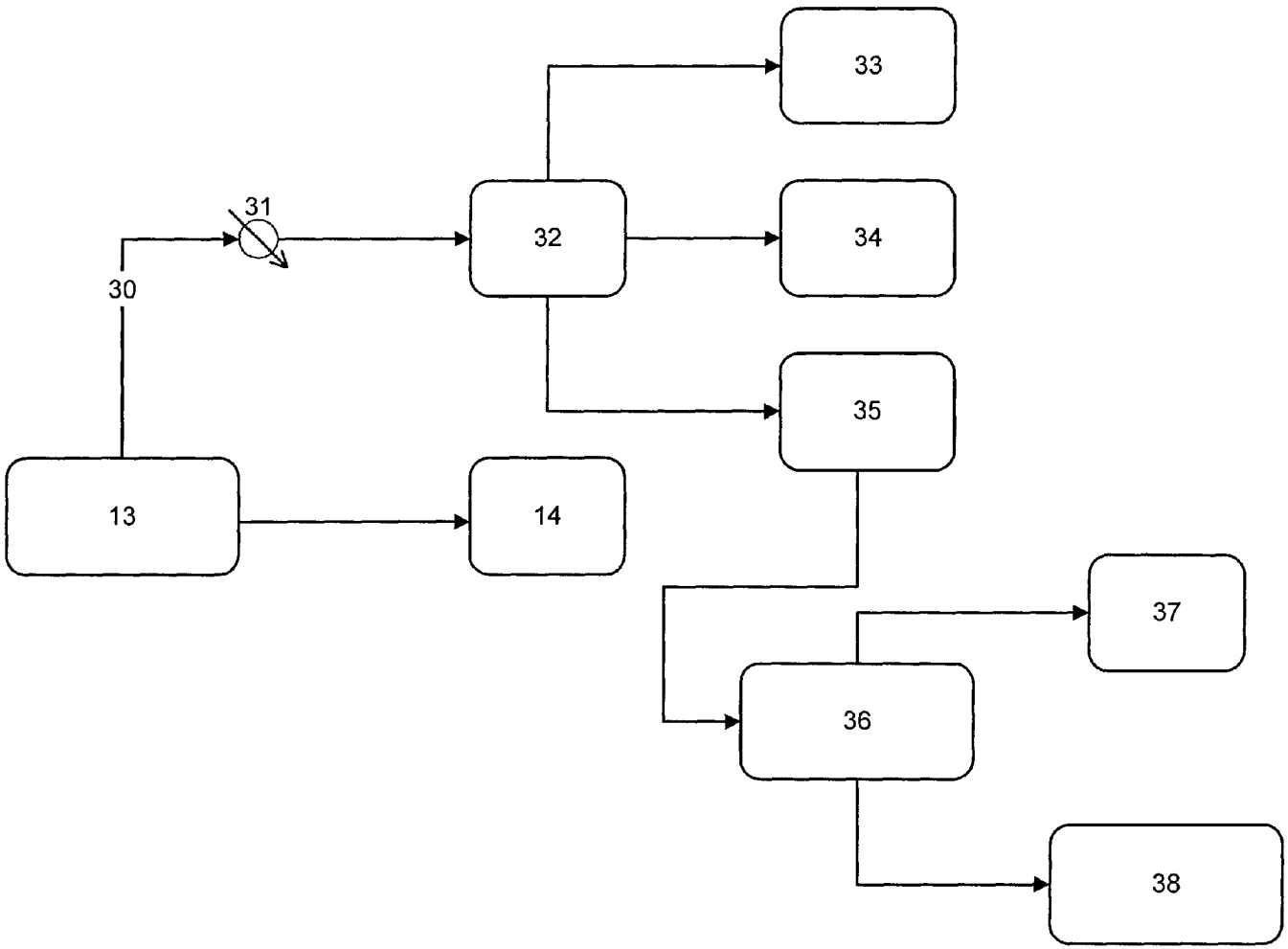
FIG. 3 is a diagram that illustrates how reaction water from the Fischer-Tropsch synthesis process may be used as the source of the acid used in the acid treatment process.

Referring to FIG. 3, a Fischer-Tropsch reactor 13 produces a paraffinic product stream 14, which may be a wax stream, and a vapor stream 30. The temperature of the vapor stream 30 may be reduced in a cooler 31 before being passed to a high pressure separator drum 32. The separator drum 32 (which may also be called a three-phase separator) may be operated at temperatures of about 120 to 140° F. Effluent streams from the separator drum 32 may include a tail gas stream 33, a $C_2$-$C_{20}$ condensate stream 34, and raw reaction water stream 35. It will of course be understood by those skilled in the art that the reaction water 35 is a product of the Fischer-Tropsch synthesis reaction.

The raw reaction water 35 may then be passed to a primary distillation unit 36 to separate the raw reaction water 35 into a phase 37 that includes alcohols such as methanol and ethanol, and a concentrated reaction water 38 that comprises mostly acetic acid in water. The raw reaction water 35 may be sent to a storage tank before being passed to the primary distillation unit 36.

According to embodiments of the present invention, at least three of the aqueous based streams shown in FIG. 3 are suitable for treating the Fischer-Tropsch product stream 14 in an acid treatment process; these are stream 35, 37, and 38. Acetic acid is typically the acid component of the three aqueous based acidic streams 35, 37, and 38, and may be present in each stream in amounts ranging from about 0.01 to 0.05 weight percent in one embodiment, and from about 0.02 to 0.04 weight percent in another embodiment.

The components of the raw reaction water 35 present in the largest quantities are typically methanol and ethanol, and there may be smaller amounts of n-propanol, n-butanol, and n-pentanol. Typical amounts of methanol and ethanol in the raw reaction water 35 range from about 0.5 to 1.0 weight percent; the remaining alcohols are present at levels of about 0.02 to 0.2 weight percent.

The aqueous stream 37 will of course have larger concentrations of alcohols than the raw reaction water stream 35 does as a result of the distillation process that takes place in the primary distillation unit 36. Typical amounts of methanol and ethanol in the aqueous stream 37 range from about 15 to 30 percent by weight, with the longer alcohols n-propanol, n-butanol, and n-pentanol ranging from about 2 to 15 weight percent. In an alternative embodiment, the aqueous stream 37 may be burned as a fuel source.

The concentrated reaction water stream 38 contains substantially no alcohols. The dominant component in this stream is acetic acid present in amounts, as discussed above, ranging from about 0.01 to 0.05 weight percent.

EXAMPLES

The following examples illustrate various ways in which an acid extraction process may be used to treat a Fischer- Tropsch derived product stream before sending that stream on to hydroprocessing. The following examples are given for the purpose of illustrating embodiments of the present invention, and should not be construed as being limitations on the scope or spirit of the instant invention.

Example 1

Acid Extraction of a Fischer-Tropsch Product Stream

This example gives the results of an acid extraction process performed on a Fischer-Tropsch derived paraffinic product stream, wherein the extraction is carried out with an aqueous stream containing a dilute acid. Prior to the acid extraction step, the Fischer-Tropsch product stream was filtered using conventional filtration techniques known to those skilled in the art. The filtered Fischer-Tropsch product stream was then mixed with a dilute aqueous acid in ratio of about 2:1 (by weight), and the mixture charged to a tumbling autoclave. The extraction was then carried out in the tumbling autoclave at a temperature of about 150° C. for a duration of about 4 days.

The inventors have found that in the absence of the present acid extraction process, the Fischer-Tropsch product stream was found to plug the catalyst beds of a hydrotreating reactor even if the product stream had been filtered by conventional filtering techniques known in the art. The plugging was found to occur in less than about one tenth of the desired catalyst life.

The levels of contamination in the Fischer-Tropsch wax were compared with the levels of each element in the paraffinic phase measured again after extraction. The extraction was performed with a variety of acids. Table I shows the amount of the contamination present in the paraffinic phase after the Fischer-Tropsch wax had been treated with a dilute aqueous acid:

TABLE I

| | | Amount of contaminant in the paraffinic phase (ppm) | | | | | |
|---|---|---|---|---|---|---|---|
| Acid type | Concentration | Al | Co | Fe | Si | Sn | Zn |
| FT wax (no extraction) | — | 29 | 2.4 | 0.5 | 1 | 0.3 | 0.1 |
| HCl | 0.1 M | <1.8 | <0.6 | <1.7 | 2 | <1.2 | <0.6 |
| HCl | 0.1 M | <1.2 | <0.6 | <0.6 | <0.7 | <1.1 | <0.6 |
| HCl | 0.01 M | 9.9 | 0.7 | <0.5 | 2.1 | 1.3 | <0.5 |
| $H_2SO_4$ | 0.1 M | <3.3 | <0.5 | <0.5 | <2.6 | <1.9 | <0.5 |
| $HNO_3$ | 0.1 M | <1.1 | <0.5 | <0.5 | <2.5 | <1.0 | <0.5 |
| Formic | 0.1 M | 14.4 | 0.8 | <0.5 | <2.2 | 1.3 | <0.5 |
| Acetic | 0.1 M | 18 | 0.9 | 7.1 | 26.6 | 2.3 | <0.8 |
| Propionic | 0.1 M | 20.9 | 1.1 | <0.6 | 1.8 | 2.4 | <0.6 |
| Butyric | 0.1 M | 21.8 | 1.1 | <0.5 | 2.5 | 2 | <0.5 |
| Oxalic | 0.1 M | <0.8 | <0.4 | <0.4 | 0.9 | <0.1 | <0.4 |

The numbers in the body of the table represent the amount of an element present in the paraffinic phase after extraction. The technique used to do the elemental analysis was inductively coupled plasma atomic emission spectroscopy (ICP-AES). In this technique, the sample was placed in a quartz vessel (ultrapure grade) to which was added sulfuric acid, and the sample was then ashed in a programmable muffle furnace for 3 days. The ashed sample was then digested with HCl to convert it to an aqueous solution prior to ICP-AES analysis.

The data from Table I clearly show that contaminants are still present in a conventionally filtered Fischer-Tropsch product stream even after that stream had been filtered, but that these contaminants had been substantially removed from the paraffinic stream after it had been extracted with the dilute aqueous acid.

The acid in the acid extraction procedure may comprise either an inorganic or an organic acid, although inorganic acids appear, in general, to be more successful at removing contaminants according to embodiments of the present invention. In addition, a gray interface was observed in the case of the organic acids and very dilute inorganic acids, where the gray interface complicated the separation. The inorganic acids in this experiment comprised hydrochloric acid (HCl), sulfuric acid ($H_2SO_4$), and nitric acid ($HNO_3$). In general, inorganic acids successfully extracted contaminants at acid concentrations of about 0.1 M, and the preferred acid in one embodiment was sulfuric acid. Table II also shows that in one case (HCl) an acid concentration of 0.1 M was more effective at extracting contaminants than the same acid at a concentration of 0.01 M.

With the exception of oxalic acid, the organic acids were not as successful at extracting contaminants, particularly for removing aluminum. The organic acids in this experiment comprised formic acid, acetic acid, propionic acid, butyric acid, and oxalic acid. In this example, oxalic acid was able to remove contaminants with the same degree of efficiency as many of the inorganic acids.

Example 2

Comparison of an Acid Extraction Treatment with a Water Extraction Treatment In this experiment, an acid extraction treatment was compared with a water extraction treatment to determine their relative abilities at removing contamination from a Fischer-Tropsch product stream. A filtered Fischer-Tropsch product stream was extracted with a dilute aqueous acidic stream at a 1:1 ratio (wt/wt) in a tumbling autoclave at 170° C. for 4 days. As in the previous example, the Fischer-Tropsch product stream was filtered by conventional techniques known to those skilled in the art. The results are shown in Table II:

TABLE II

| | Contaminants in wax phase (ppm) | | | | | | Contaminants in aqueous phase (ppm) | | | | | |
|---|---|---|---|---|---|---|---|---|---|---|---|---|
| Treatment | Al | Co | Fe | Si | Sn | Zn | Al | Co | Fe | Si | Sn | Zn |
| Fischer-Tropsch wax (no treatment) | 29 | 2.4 | 0.5 | 1 | 0.3 | 0.1 | — | — | — | — | — | — |
| Water | 22 | 1.7 | 0.8 | 0.3 | 1.5 | 0.5 | 3.7 | 0.7 | 0.7 | 2.8 | 0.7 | 0.7 |
| HCl (0.1M) | 1.3 | 0.2 | 0.4 | 0.3 | 0.1 | 0.4 | 24 | 2 | 1.7 | 3.5 | 0.8 | 0.6 |

Table II shows that water treatment was not effective in extracting the contaminants from the Fischer-Tropsch product stream (labeled "Fischer-Tropsch wax" in the table). For example, the aluminum content in the paraffinic wax phase was only reduced from about 29 to about 22 ppm with extraction, and the amount of the aluminum going into the aqueous phase of the water-only treatment was only about 3.7 ppm.

In contrast, the aluminum content was reduced from about 29 to about 1.3 ppm when the treatment comprised mixing the Fischer-Tropsch product stream with a 0.1 M HCl stream.

The aqueous phase (now a dilute acid in water) contained 24 ppm of the aluminum contaminant extracted from the Fischer-Tropsch product stream.

Example 3

Miscellaneous Treatments

Table III shows the results of treating a Fischer-Tropsch product stream with a variety of different test mixtures, the treatment being carried out at 100° C. with constant rapid stirring:

TABLE III

| | Elemental contaminants in the treated Fischer-Tropsch paraffinic phase (ppm) | | | | | |
|---|---|---|---|---|---|---|
| Test mixture | Al | Co | Fe | Si | Sn | Zn |
| Fischer-Tropsch wax (no treatment) | 23 | 2 | 4 | 5 | <1 | <1 |
| 1 wax: 4 water | 25 | 2 | 1 | <1 | 4 | <1 |
| 1 wax: 2 sim. sour Fischer-Tropsch $H_2O$ | 25 | 2 | 1 | <1 | 5 | <1 |
| 1 wax: 1 $H_2SO_4$ (0.1M) | 2 | <1 | 2 | <1 | <1 | <1 |

Referring to Table III, one skilled in the art will note that an extraction with an aqueous phase comprising only water (meaning no acid content) is still not effective at removing contaminants, even when the ratio by weight of the aqueous phase to the Fischer-Tropsch product stream is increased from 1:1 to 1:4. Additionally, an extraction with a simulated Fischer-Tropsch process reaction water was likewise not effective. Subsequent testing with actual Fischer-Tropsch reaction water did show some effectiveness. The simulated reaction water may act differently from real reaction water due to the low concentrations of other components. For example, varying levels of surfactants may have been responsible for varying interactions between the water and the wax, thus making the extraction with real reaction water more effective. As before, however, an extraction with an inorganic acid was effective at reducing contamination in the paraffinic wax phase, in this case the acid treatment comprised sulfuric acid at a concentration of about 0.1 M.

Example 4

Effect of Wax Feed Pumping Rate on Contamination Extraction

An example of the effect of the pumping rate of the Fischer-Tropsch product stream 14 on degree to which contamination may be extracted is shown in FIG. 4. In this example, the metals content of a Fischer-Tropsch wax was measured after being contacted with the reaction water by-product from a Fischer-Tropsch synthesis process, the reaction water being acidic. The reaction water was static in the experiment, and the Fischer-Tropsch wax pumped through the reaction water at varying rates. As the pumping rate was increased, the average droplet size of the wax decreased, and thus the surface area contact between the wax and the acidic reaction water was increased. In FIG. 4, the wax droplet size decreases from left to right in the graph. As the wax pump rate was increased from 20 to 50 percent of maximum flow, the metal content in the product decreased from about 45 ppm to about 20 ppm as a result of the larger surface area, and greater degree of contact with the acidic reaction water.

Example 5

Effect of Reactor Configuration

In this example, the effect of three different types of reactor configuration was investigated: 1) wax bubble column, 2) two-phase injection, and 3) acid spray column. Each of the columns had a two inch internal diameter, and was operated at a temperature of about 325° F. and a pressure of about 120 psig. Feed rates are reported in the following tables in grams/minute (g/min.).

For the experiments whose results are shown in Table IV, wax samples were collected either from the product line, or from a side port on the reactor. Some of the samples were passed through either a 2 or 0.5 micron inline sintered stainless steel filter. Selected samples were later reheated and filtered using a 0.45 micron nylon filter.

TABLE IV

| Source of sample | Configuration | Wax feed rate (g/min) | FT water feed rate (g/min) | Inline Filter (microns) | Al in wax after acid treatment (ppm) | Al in wax after additional 0.45 μm filtering (ppm) |
|---|---|---|---|---|---|---|
| Wax feed | | | | | 50 | |
| Wax product | Bubble column | 68 | 0 | 2 | 49.2 | |
| Wax product | Bubble column | 136 | 0 | 2 | 43.8 | |
| Wax product | Bubble column | 200 | 0 | 2 | 35.3 | 9.3 |
| Wax feed | | | | | 48.1 | |
| Wax product | Two-phase injection | 67 | 77 | None | 28.5 | |
| Wax product | Two-phase injection | 67 | 77 | None | 20.6 | |
| Wax product | Two-phase injection | 50 | 45 | None | 15.8 | |
| Wax product | Two-phase injection | 50 | 45 | None | | 3.4 |
| Side port | Spray column | 0 | 60 | 2 | 39.8 | 2.4 |
| Side port | Spray column | 0 | 60 | 2 | 37.4 | 2.4 |
| Side port | Spray column | 0 | 60 | 2 | 36.8 | |
| Side port | Spray column | 0 | 60 | 2 | 33.4 | 1.4 |
| Side port | Spray column | 0 | 60 | 0.5 | 37.7 | <1.1 |
| Side port | Spray column | 0 | 60 | None | | <1.0 |

The bubble column configuration was somewhat effective at removing contamination (when a 200 g/min wax feed rate was used), reducing the Al content by about 30 percent, and particularly effective when the acid treatment was followed up with a filtering step. With subsequent filtering, over 80 percent of the aluminum originally present in the wax was removed.

The spray column configuration was similarly effective at removing contamination after acid treatment, and even more effective than the bubble column configuration after subsequent filtering, where about 98 percent of the aluminum was removed.

The two phase injection configuration was most effective at removing contamination after acid treatment, presumably because of better mixing of the wax phase with the aqueous acid phase. For this case, 60 to 70 percent of the aluminum contamination was removed after the acid treatment.

Example 6

Effect of Reactor Configuration

Experiments similar to those in Example 5 were conducted using a wax feed having an initial aluminum contamination concentration of about 12 ppm. In this example, the size of the inline filter (when used) was reduced from the 2 micron size predominantly used in Example 5 to 0.5 microns in this example. As before, each of the columns had a two inch internal diameter, and was operated at a temperature of about 325° F. and a pressure of about 120 psig.

TABLE V

| Source of sample | Configuration | Wax feed rate (g/min) | FT water feed rate (g/min) | Inline Filter (microns) | Al in wax after acid treatment (ppm) | Al in wax after additional 0.45 μm filtering (ppm) |
|---|---|---|---|---|---|---|
| Wax feed | | | | | 12.26 | |
| Wax product | Bubble column | 132 | 0 | None | | 8.96 |
| Wax product | Bubble column | 132 | 0 | 0.5 | 12.45 | |
| Wax product | Bubble column | 132 | 0 | 0.5 | 11.6 | |
| Wax product | Bubble column | ? | ? | None | 10.8 | |
| Wax product | Two-phase injection | 64 | 67 | 0.5 | 3.15 | |
| Wax product | Two-phase injection | 131 | 67 | None | 5.53 | |
| Wax product | Two-phase injection | 131 | 67 | None | | 3.51 |
| Wax product | Two-phase injection | 131 | 67 | 0.5 | 5.53 | |
| Wax product | Two-phase injection | 131 | 67 | None | 6.25 | |
| Wax product | Two-phase injection | 131 | 67 | 0.5 | 6.26 | |
| Wax product | Spray column | 130 | 70 | None | | 3.22 |
| Wax product | Spray column | 130 | 70 | None | 6.6 | |
| Wax product | Spray column | 130 | 70 | 0.5 | 4.61 | |
| Wax product | Spray column | ? | ? | 0.5 | 7.5 | 1.4 |

Similar to the results of Example 5, the two-phase injection configuration was the most effective at removing aluminum contamination within the experimental confines of Example 6.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

What is claimed is:

1. A method of removing contamination from a Fischer-Tropsch derived waxy paraffinic product stream containing Al contamination that is not filterable to 0.1 microns and comprising aluminum metal present in a complex organic matrix, the method comprising:

a) conducting a Fischer-Tropsch process in a slurry type reactor using a catalyst comprising cobalt at a temperature range of about 400 to 550° F. to produce a Fischer-Tropsch derived waxy paraffinic product stream containing Al contamination that is not filterable to 0.1 microns and comprising aluminum metal present in a complex organic matrix;

b) passing the Fischer-Tropsch derived waxy paraffinic product stream to a treatment zone;

c) passing an aqueous acidic stream to the treatment zone;

d) contacting the Fischer-Tropsch derived waxy paraffinic product stream with the aqueous acidic stream in the treatment zone to form a mixed stream containing the Al contamination in particulate form;

e) separating the mixed stream into at least one acidic extracted Fischer-Tropsch derived waxy paraffinic product stream, and at least one modified aqueous acidic stream;

f) passing the at least one acidic extracted Fischer-Tropsch derived waxy paraffinic product stream to a hydroprocessing reactor containing catalyst beds; and g) hydroprocessing the acidic extracted Fischer-Tropsch derived waxy paraffinic product stream to provide a hydroprocessed product stream, wherein the contacting step substantially reduces plugging of catalyst beds in the hydroprocessing reactor.

2. The method of claim 1, wherein the contacting step forms a third phase substantially distinct from the at least one extracted Fischer-Tropsch derived waxy paraffinic product stream and the at least one modified aqueous acidic stream, and wherein the aqueous acidic stream extracts the contamination from the Fischer-Tropsch derived waxy paraffinic product stream and isolates it in the third phase.

3. The method of claim 1, wherein the contamination originates from upstream processing equipment.

4. The method of claim 1, wherein the contamination originates from the catalyst comprising cobalt used to produce the Fischer-Tropsch derived waxy paraffinic product stream.

5. The method of claim 1, wherein the contacting step is performed as a batch process.

6. The method of claim 1, wherein the contacting step is performed as a continuous process.

7. The method of claim 1, wherein the aqueous acid stream comprises an acid dissolved in water, and wherein the concentration of the acid in the water ranges from about 0.0001 to 1 M.

8. The method of claim 7, wherein the concentration of the acid in the water ranges from about 0.01 to 0.1 M.

9. The method of claim 1, wherein the aqueous acidic stream comprises an organic acid dissolved in water, the organic acid selected from the group consisting of formic acid, acetic acid, propionic acid, butyric acid, and oxalic acid.

10. The method of claim 1, wherein the aqueous acidic stream comprises an inorganic acid dissolved in water, the inorganic acid selected from the group consisting of hydrochloric acid, sulfuric acid, and nitric acid.

11. The method of claim 1, wherein the aqueous acidic stream comprises reaction water produced in a Fischer-Tropsch hydrocarbon synthesis.

12. The method of claim 11, wherein the reaction water comprises acetic acid.

13. The method of claim 1, wherein the extraction step is performed in a mixing apparatus.

14. The method of claim 13, wherein the mixing apparatus is selected from the group consisting of a mixing valve, an orifice plate, an inline static mixer, an extraction column with sparger, and a commercial mixing apparatus.

15. The method of claim 14, wherein the extraction column is selected from the group consisting of a wax bubble column, a two-phase injection, and an acid spray column.

16. The method of claim 1, further including the step of distilling the Fischer-Tropsch derived waxy paraffinic product stream.

17. The method of claim 1, further including the step of adding a surfactant to the Fischer-Tropsch derived waxy paraffinic product stream.

18. A method of removing contamination from a Fischer-Tropsch derived waxy paraffinic product stream containing Al contamination that is not filterable to 0.1 microns and comprising aluminum metal present in a complex organic matrix, the method comprising:

a) conducting a Fischer-Tropsch process in a slurry type reactor using a catalyst comprising cobalt at a temperature range of about 400 to 550° F. to produce a Fischer-Tropsch derived waxy paraffinic product stream containing Al contamination that is not filterable to 0.1 microns and comprising aluminum metal present in a complex organic matrix;

b) passing the Fischer-Tropsch derived waxy paraffinic product stream to a treatment zone;

c) passing an aqueous acidic stream to the treatment zone;

d) extracting the Al contamination from the Fischer-Tropsch derived waxy paraffinic product stream by contacting the Fischer-Tropsch derived waxy paraffinic product stream with the aqueous acidic stream in the treatment zone at extraction conditions to form a mixed stream comprising at least one acidic extracted Fischer-Tropsch derived waxy paraffinic product stream, a modified aqueous acidic stream, and a third phase; and e) separating the at least one acidic Fischer-Tropsch derived waxy paraffinic product stream from the modified aqueous acidic stream and the third phase, wherein after the extraction step the Al contamination contained in the modified aqueous acidic stream and the third phase is greater than the contamination contained in the extracted Fischer-Tropsch derived waxy paraffinic product stream.

19. The method of claim 18, wherein after the extracting step the contamination contained in the modified aqueous acidic stream and the third phase is at least 10 times greater than the contamination contained in the extracted Fischer-Tropsch derived waxy paraffinic product stream.

20. The method of claim 18, wherein the extraction conditions include a temperature ranging from about 200 to 600° F. and a residence time ranging from about 10 seconds to 5 days.

21. The method of claim 18 further comprising the step of passing the at least one acidic extracted Fischer-Tropsch derived waxy paraffinic product stream to a hydroprocessing reactor.

22. The method of claim 21, wherein the extraction step substantially reduces plugging of catalyst beds in the hydroprocessing reactor.

23. A method of removing contamination from a Fischer-Tropsch derived waxy paraffinic product stream containing Al contamination that is not filterable to 0.1 microns and comprising aluminum metal present in a complex organic matrix, the method comprising:

a) passing a syngas to a Fischer-Tropsch slurry reactor to produce a Fischer-Tropsch derived waxy paraffinic product stream containing Al contamination that is not filterable to 0.1 microns and comprising aluminum metal present in a complex organic matrix;

b) providing an additive to the contents of the Fischer-Tropsch slurry reactor to precipitate soluble Al contamination within the reactor;

c) filtering the precipitated Al contamination from the Fischer-Tropsch derived waxy paraffinic product stream to produce a filtered paraffinic stream; and d) passing the filtered paraffinic stream to a hydroprocessing reactor, wherein the Fischer-Tropsch slurry reactor is run under continuous operation.

24. The method of claim 23, wherein the additive is selected from the group consisting of an acidic component and a surfactant.

25. The method of claim 1, further comprising filtering the at least one acidic extracted Fischer-Tropsch derived waxy hydrocarbon stream to remove at least a portion of the Al contamination in particulate form prior to passing to the hydroprocessing reactor; and wherein the combination of the contacting step and the filtering step substantially reduces plugging of catalyst beds in the hydroprocessing reactor.

26. The method of claim 1, further comprising the step of filtering the Fischer-Tropsch derived waxy paraffinic product stream.

27. The method of claim 26, wherein the filtering step is performed after the contacting step.

28. The method of claim 18, further comprising the step of filtering the Fischer-Tropsch derived waxy paraffinic product stream.

29. The method of claim 28, wherein the filtering step is performed after the extracting step.

* * * * *